US006830470B1

(12) United States Patent
Lynch et al.

(10) Patent No.: US 6,830,470 B1
(45) Date of Patent: Dec. 14, 2004

(54) ELECTRICAL DEVICE CONNECTOR

(75) Inventors: John M. Lynch, Forest Grove, OR (US); Jerry Bolen, Molalla, OR (US)

(73) Assignee: Intel Corporation, Santa Clara, CA (US)

( * ) Notice: Subject to any disclaimer, the term of this patent is extended or adjusted under 35 U.S.C. 154(b) by 0 days.

(21) Appl. No.: 10/600,668

(22) Filed: Jun. 20, 2003

(51) Int. Cl.[7] ..... H01R 13/62

(52) U.S. Cl. ..... 439/326; 439/79; 439/572; 439/636

(58) Field of Search ..... 439/636–637, 439/325–326, 571–572, 79

(56) References Cited

U.S. PATENT DOCUMENTS 5,964,606 A 10/1999 Choy
6,116,917 A * 9/2000 Choy ..... 439/79
6,685,511 B2 * 2/2004 Akama et al. ..... 439/610

* cited by examiner

*Primary Examiner*—Truc Nguyen
(74) *Attorney, Agent, or Firm*—Buckley, Maschoff & Talwalkar LLC

(57) ABSTRACT

According to some embodiments, a device includes a connector to hold an electrical module at an acute angle with respect to a surface on which the connector is to be mounted, and a first contact, a first portion of the first contact to contact the surface and a second portion of the contact to contact the electrical module, a distance between the first portion and the second portion equal to a first length. A device may also include a second contact adjacent to the first contact, a first portion of the second contact to contact the surface and a second portion of the second contact to contact the electrical module, a distance between the first portion of the second contact and the second portion of the second contact substantially equal to the first length.

22 Claims, 5 Drawing Sheets

ELECTRICAL DEVICE CONNECTOR

BACKGROUND

Card edge connectors may be used to hold electrical modules such as Dual In-Line Memory Modules and to electrically couple such modules to a bus. A vertical card edge connector holds an electrical module in a vertical position. Vertical card edge connectors are unsuitable for some small form factor applications because the total height of the connector/module combination exceeds the applications' specifications.

An angled card connector may be used to reduce the height of the connector/module combination. More specifically, an angled card edge connector may hold an electrical module at an acute angle with respect to the surface on which the connector is mounted. Therefore, for a given electrical module, a height of a connector/module combination will be less if an angled card edge connector is used than if a vertical card edge connector is used. Conventional angled card edge connectors may, however, fail to provide suitable signaling between a bus and an electrical module in some applications.

DETAILED DESCRIPTION

Figure 1:
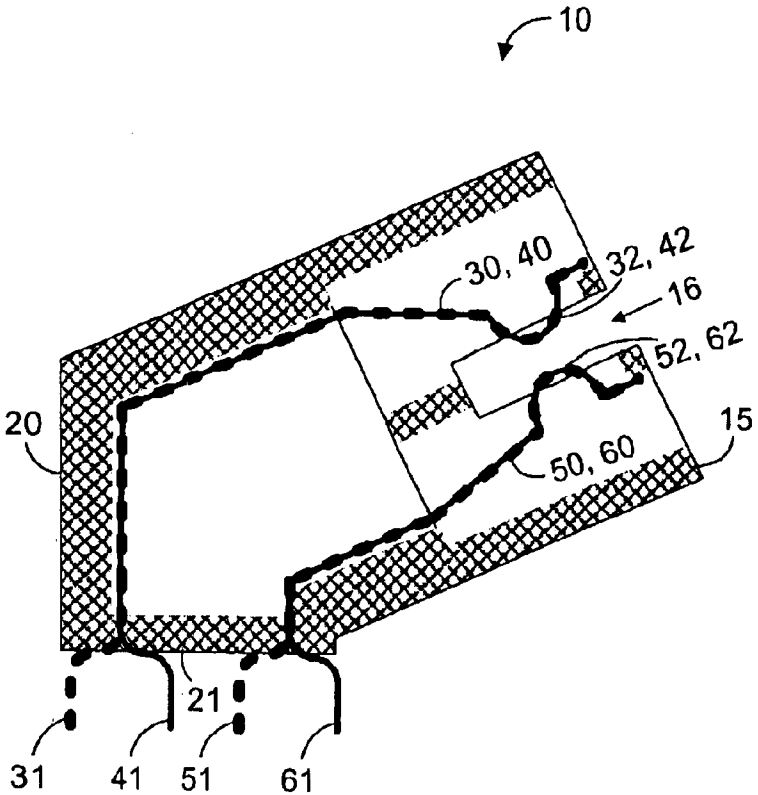
FIG. 1 is a cutaway view of a device according to some embodiments.

FIG. 1 is a cutaway view of connector 10 according to some embodiments. Connector 10 may be used to hold an electrical module and to electrically couple the electrical module to a bus. Connector 10 may also hold the electrical module at an angle, which may reduce a total height of the connector/module combination in comparison to a connector/module combination in which the module is held vertically.

Connector 10 includes receptacle 15 and base 20. Receptacle 15 and base 20 may be coupled using any suitable coupling. In one example, receptacle 15 and base 20 are integrally formed from a single mold. Receptacle 15 defines opening 16 in which an electrical module may be received. Base 20 includes lower surface 21. Lower surface 21 may form an acute angle (e.g. 25 degrees) with an electrical module received in opening 16.

Connector 10 also includes contacts 30, 40, 50 and 60. Contacts 30, 40, 50 and 60 may be used to electrically couple an electrical module received in opening 16 to one or more signal lines. Contacts 30, 40, 50 and 60 may comprise phos-bronze or brass according to some embodiments.

Contacts 30 and 40 are adjacent to each other in the illustrated embodiment. As shown, portion 31 of contact 30 protrudes from lower surface 21 and portion 32 of contact 30 protrudes from receptacle 15 into opening 16. Similarly, portion 41 of contact 40 protrudes from lower surface 21 and portion 42 of contact 40 protrudes from receptacle 15 into opening 16.

Portions 31 and 41 may comprise a pin, a solder bump, and/or or any other element to electrically couple contacts 30 and 40, respectively, to an external signal line. In specific examples, portions 31 and 41 comprise tin or tin/lead-plated phos-bronze. Portions 32 and 42 may comprise a pad, a bare wire, a coated wire and/or another element to electrically couple contacts 30 and 40, respectively, to an electrical circuit of an electrical module received in opening 16. Portions 32 and 42 comprise phos-bronze with gold plating and nickel underplating according to some embodiments.

Figure 2:
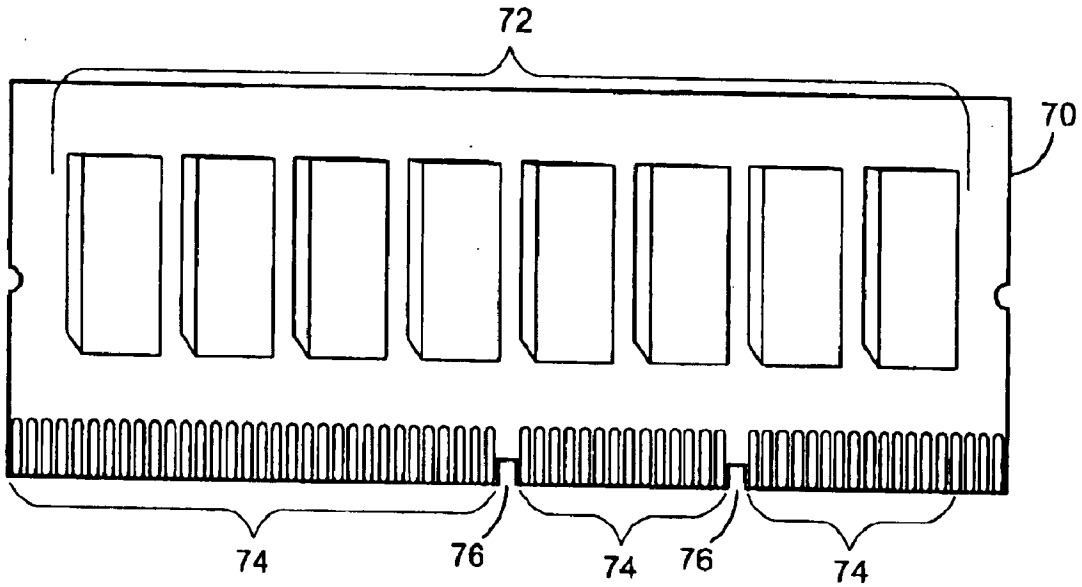
FIG. 2 is a plan view of a dual in-line memory module.

Portions 32 and 42 may couple contacts 30 and 40 to an electrical module by contacting connection pads of the electrical module. FIG. 2 is a view of an electrical module that may be used in conjunction with some embodiments. Module 70 is a Double Data Rate Dual In-Line Memory Module (DIMM) which includes integrated circuits 72, connection pads 74 and mounting structures 76. Although FIG. 2 illustrates only one side of module 70, the unshown side also includes additional connection pads 74 and may include additional integrated circuits 72.

Portions 32 and 42 therefore contact respective ones of connection pads 74 in a case that module 70 is received in opening 16. The respective ones of connection pads 74 may be adjacent to one another on module 70. Receptacle 15 may include structures corresponding to mounting structures 76 to enable a secure physical connection between receptacle 15 and module 70. Other types of electrical modules which differ in electrical function, physical configuration or otherwise from module 70 may be used in conjunction with some embodiments. As non-exhaustive examples, module 70 may be a Double Data Rate DIMM with a different physical configuration, a Single Data Rate or a Quad Data Rate DIMM with a same or different physical configuration, another type of memory module such as a Single In-Line Memory Module (SIMM), and/or a module having a same or different physical configuration that provides a function other than memory storage.

According to some embodiments, contact 30 and contact 40 are of substantially the same length. In some embodiments, a distance between portion 31 and portion 32 is substantially equal to a distance between portion 41 and 42. The substantially equal distances may reduce signal skew of signals carried by contacts 30 and 40 to respective ones of connection pads 74 in comparison to conventional systems.

As described above with respect to contacts 30 and 40, contacts 50 and 60 are adjacent to each other. Portion 51 of contact 50 protrudes from lower surface 21 and portion 61 of contact 60 protrudes from lower surface 21. Portions 51, 52, 61 and 62 may comprise any of the alternatives mentioned above with respect to corresponding portions 31, 32, 41 and 42.

However, portions 52 and 62 of contacts 50 and 60 protrude from a side of receptacle 15 that is different from the side of receptacle 15 from which contacts 30 and 40 protrude. Accordingly, portions 52 and 62 are to contact connection pads 74 that are disposed on a different side of module 70 than connection pads 74 with which portions 32 and 42 are to make contact.

Contact 50 and contact 60 may be of substantially the same length. The length may be different from or substantially equal to the length of contacts 30 and 40. According to some embodiments, a distance between portion 51 and portion 52 may be substantially equal to a distance between portion 61 and 62. Again, these substantially equal distances may reduce signal skew of signals carried by contacts 50 and 60 to module 70 in comparison to conventional systems.

Figure 3:
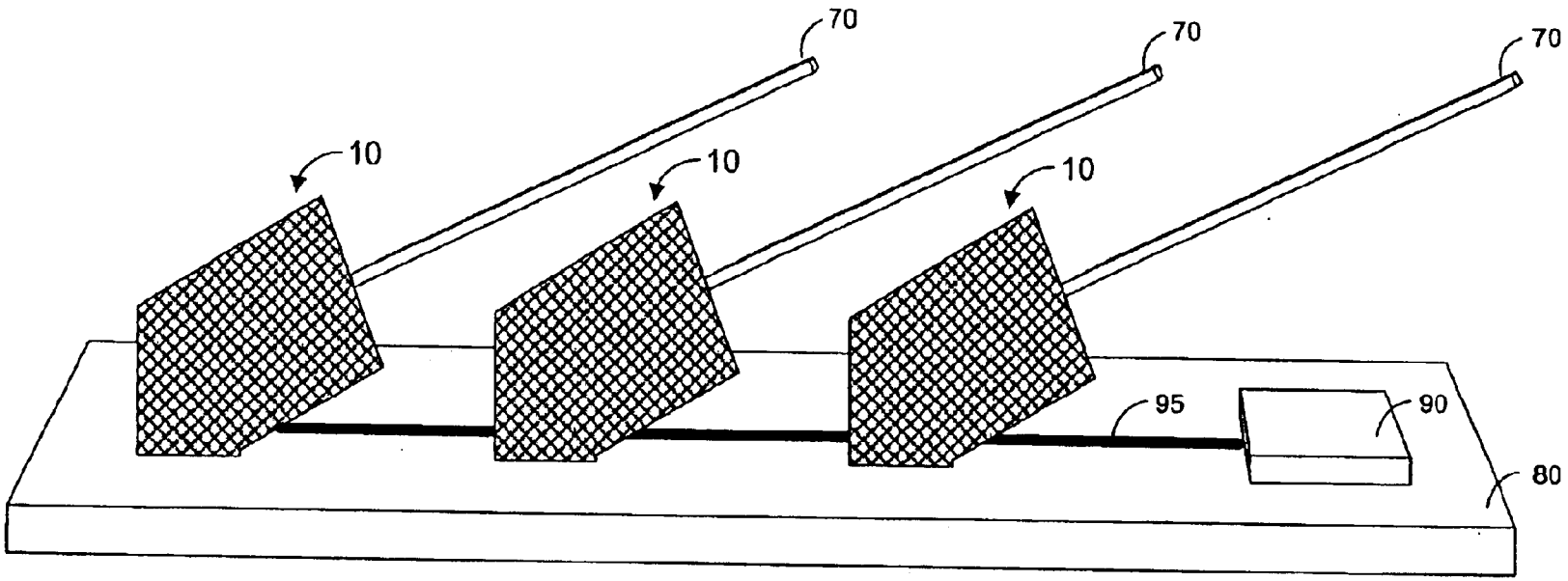
FIG. 3 is a side view of a system according to some embodiments.

FIG. 3 illustrates a system according to some embodiments. The FIG. 3 system comprises several instances of connector 10, each of which includes an instance of opening 16 (not shown) which receives a respective instance of module 70. Each instance of connector 10 is mounted on substrate 80. Substrate 80 may comprise a motherboard substrate for a computing device such as a server. Also mounted on substrate is memory controller 90, which may provide a microprocessor (not shown) with access to memory storage provided by modules 70. In this regard, memory controller 90 is coupled to bus 95 which is in turn coupled to each of connectors 10. Bus 95 may comprise a parallel memory bus, a serial memory bus, or any other bus.

Bus 95 may comprise individual signal lines, each of which is coupled to one portion of a contact protruding from one of connectors 10. According to such an arrangement, each signal line may be connected to one connection pad of each module 70. Connectors 10 may be coupled to bus 95 and to substrate 80 by soldering contact portions protruding from each connector 10 directly to bus 95. In another example, pins protruding from each connector 10 may be inserted into sockets that are mounted on substrate 80 and electrically connected to bus 95.

Figure 4:
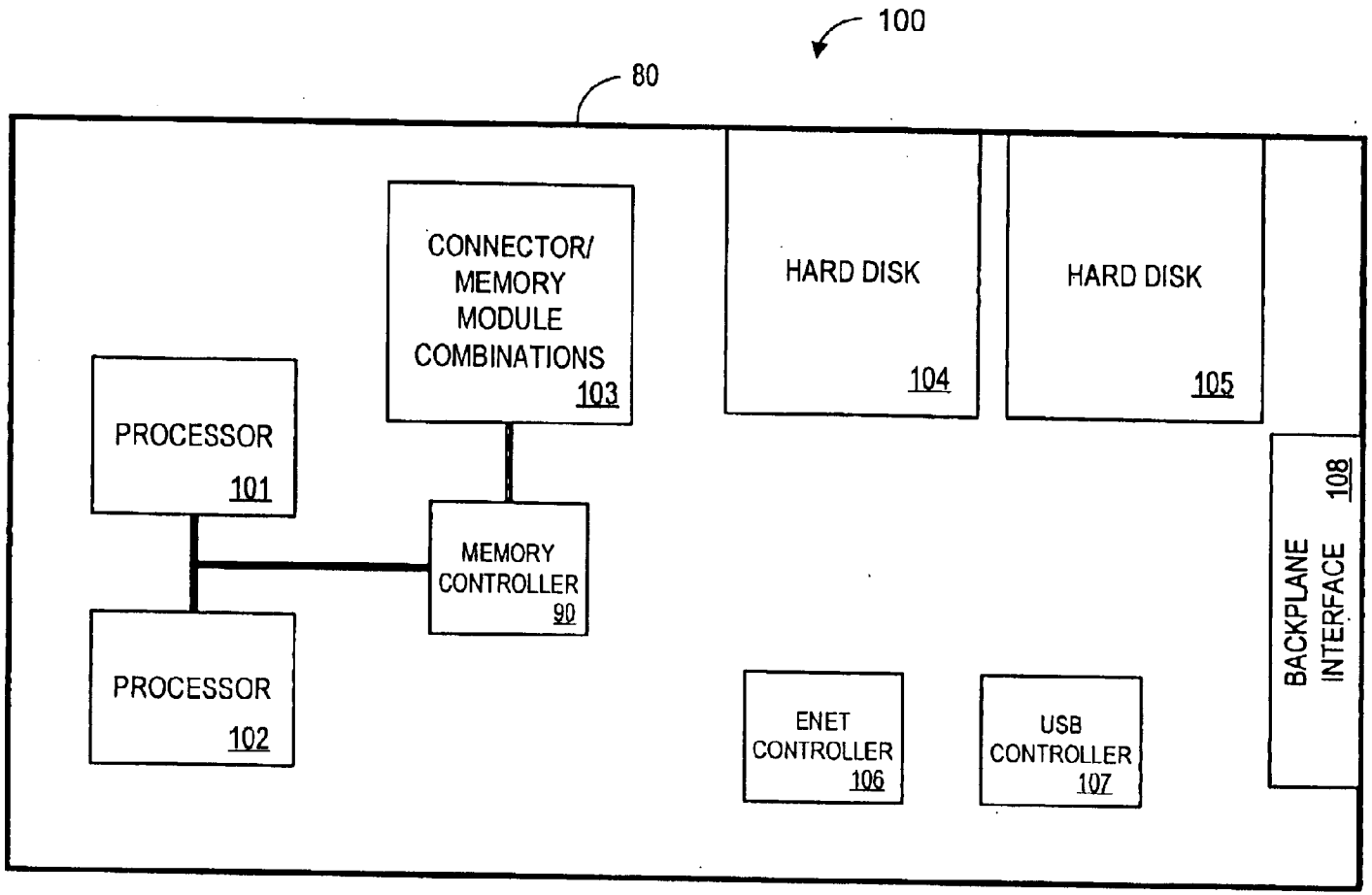
FIG. 4 is a block diagram of a system according to some embodiments.

FIG. 4 is a block diagram of system 100 according to some embodiments. System 100 may comprise a hardware server packaged within a thin enclosure, and therefore referred to as a blade server. System 100 includes previously-described substrate 80 and memory controller 90 mounted thereon. Also included are connector/memory module combinations 103 coupled to memory controller 90. Connector/memory module combinations 103 may comprise the combinations of connector 10 and module 70 shown in FIG. 3.

Memory controller 90 is coupled to processors 101 and 102, such as Intel Xeon™ processors. Memory controller 90 may therefore provide processors 101 and 102 with access to memory storage provided by combinations 103. Software applications may be stored for extended periods in hard disk drives 104 and 105. Also stored in hard disk drives 104 and 105 may be data files, device drivers, and an operating system for controlling basic functions of system 100.

Ethernet controller 106 allows system 100 to communicate with other devices via Ethernet protocol. Similarly, USB controller 107 provides communication with USB devices. The USB devices and other devices may be coupled to system 100 using backplane interface 108.

Figure 5:
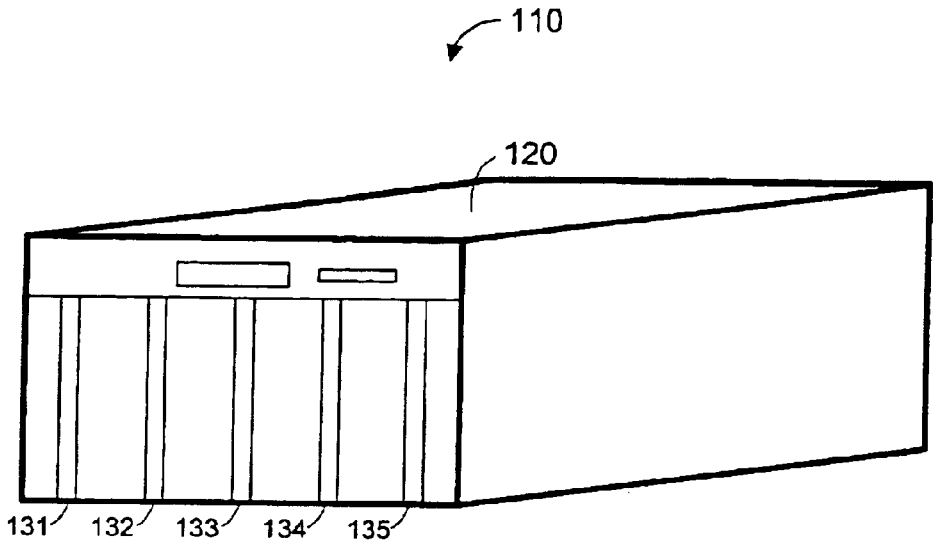
FIG. 5 is a front elevation of a system according to some embodiments.

FIG. 5 is a view of a system according to some embodiments. As shown in FIG. 5, system 110 comprises chassis 120 in which are mounted blade servers 131, 132, 133, 134, and 135, which are each similar to system 100 of FIG. 4. Blade servers 131, 132, 133, 134, and 135 are coupled via respective backplane interfaces to a midplane, which is a type of backplane that is located within chassis 120.

Chassis 120 may be coupled to one floppy disk drive, one compact disc drive, one keyboard and one mouse via respective Universal Serial Bus interfaces. Blade servers 131, 132, 133, 134, and 135 therefore share these peripheral devices amongst themselves. Chassis 120 may also includes a management module, which receives requests to access the peripheral devices from the other blade servers.

The several embodiments described herein are solely for the purpose of illustration. Embodiments may include any currently or hereafter-known elements that provide functionality similar to those described above. Therefore, persons skilled in the art will recognize from this description that other embodiments may be practiced with various modifications and alternations.

What is claimed is:

1. A device comprising:

a base comprising a lower surface;

a receptacle coupled to the base, the receptacle defining an opening to receive an electrical module, the received electrical module to form an acute angle with the lower surface;

a first contact of a first length protruding from the receptacle into the opening, the first contact having a first contact portion protruding from the lower surface; and a second contact of a second length, the second contact adjacent to the first contact, and the second contact protruding from the receptacle into the opening, the second contact having a second contact portion protruding from the lower surface;

wherein the second contact portion is bent in a reverse direction with respect to the first contact portion; and wherein the first length and the second length are substantially equal.

2. A device according to claim 1, wherein the first contact and the second contact protrude from a first side of the receptacle.

3. A device according to claim 1, wherein a portion of the first contact protruding from the base comprises a first signal line connection to couple the first contact to a first signal line, and wherein a portion of the second contact protruding from the base comprises a second signal line connection to couple the second contact to a second signal line.

4. A device according to claim 1, wherein the base and the receptacle comprise an integral unit.

5. A device according to claim 2, further comprising:

a third contact of a third length protruding from the base and protruding from the receptacle into the opening; and a fourth contact of a fourth length, the fourth contact adjacent to the third contact, and the fourth contact protruding from the base and protruding from the receptacle into the opening, wherein the third contact and the fourth contact protrude from a second side of the receptacle, and wherein the third length and the fourth length are substantially equal.

6. A device according to claim 5, wherein the first length is not substantially equal to the third length.

7. A device according to claim 1, wherein a portion of the first contact protruding into the opening comprises a first module connection to electrically couple the first contact to a first connection pad of the electrical module, and wherein a portion of the second contact protruding into the opening comprises a second module connection to electrically couple the second contact to a second connection pad of the electrical module.

8. A device according to claim 7, wherein the first contact and the second contact protrude from a first side of the opening, and further comprising:

a third contact of a third length protruding from the base and protruding from the receptacle into the opening, wherein a portion of the third contact protruding into the opening comprises a third module connection to electrically couple the third contact to a third connection pad of the electrical module; and a fourth contact of a fourth length, the fourth contact adjacent to the third contact, the fourth contact protruding from the base and protruding from the receptacle into the opening, and a portion of the fourth contact protruding into the opening comprises a fourth module connection to electrically couple the fourth contact to a fourth connection pad of the electrical module, wherein the third contact and the fourth contact protrude from a second side of the receptacle, and wherein the third length is substantially equal to the fourth length.

9. A device according to claim 8, wherein the first connection pad is adjacent to the second connection pad and is disposed on a first side of the electrical module, and wherein the third connection pad is adjacent to the fourth connection pad and is disposed on a second side of the electrical module.

10. A device according to claim 3, wherein the first signal line and the second signal line belong to a same bus.

11. A device according to claim 7, further comprising:

a plurality of contacts protruding from the base and protruding from the receptacle into the opening, wherein the first connection pad and the second connection pad are disposed on a first side of the electrical module, wherein a portion of each of the plurality of contacts protruding into the opening comprises a module connection to electrically couple each one of the plurality of contacts to one of each other connection pad disposed on the first side of the electrical module, wherein a length of each of the plurality of contacts is substantially equal to the first length and the second length.

12. A device according to claim 10, wherein the same bus is a serial memory bus.

13. A device comprising:

a connector to hold an electrical module at an acute angle with respect to a surface on which the connector is to be mounted;

a first contact, a first portion of the first contact to contact the surface and a second portion of the first contact to contact the electrical module; and a second contact adjacent to the first contact, a first portion of the second contact to contact the surface and a second portion of the second contact to contact the electrical module, wherein a distance between the first portion of the first contact and the second portion of the first contact is substantially equal to a distance between the first portion of the second contact and the second portion of the second contact; and wherein the first portion of the second contact is bent in a reverse direction with respect to the first portion of the first contact.

14. A device according to claim 13, wherein the first contact and the second contact are to contact a first side of the electrical module.

15. A device according to claim 13, wherein the first portion of the first contact comprises a first signal line connection to couple the first contact to a first signal line, and wherein the first portion of the second contact comprises a second signal line connection to couple the second contact to a second signal line.

16. A device according to claim 14, further comprising:

a third contact, a first portion of the third contact to contact the surface and a second portion of the third contact to contact a second side of the electrical module; and a fourth contact adjacent to the third contact, a first portion of the fourth contact to contact the surface and a second portion of the fourth contact to contact the second side of the electrical module, wherein a distance between the first portion of the third contact and the second portion of the third contact is substantially equal to a distance between the first portion of the fourth contact and the second portion of the fourth contact.

17. A device according to claim 16, wherein the distance between the first portion of the first contact and the second portion of the first contact is not equal to the distance between the first portion of the third contact and the second portion of the third contact.

18. A device according to claim 15, wherein the first signal line and the second signal line belong to a same bus.

19. A device according to claim 18, wherein the same bus is a serial memory bus.

20. A device according to claim 14, further comprising:

a plurality of contacts, a first portion of each of the plurality of contacts to contact the surface and a second portion of each of the plurality of contacts to contact the first side of the electrical module, wherein a distance between the first portion of each contact to contact the first side of the electrical module and the second portion of each contact to contact the first side of the electrical module is substantially equal.

21. A system comprising:

a double data rate dual in-line memory module;

a connector to hold the module at an acute angle with respect to a surface on which the connector is mounted;

a first contact, a first portion of the first contact contacting the surface and a second portion of the first contact contacting the module; and a second contact adjacent to the first contact, a first portion of the second contact contacting the surface and a second portion of the second contact contacting the module;

wherein the first portion of the second contact is bent in a reverse direction with respect to the first portion of the first contact; and wherein a distance between the first portion of the first contact and the second portion of the first contact is substantially equal to a distance between the first portion of the second contact and the second portion of the second contact.

22. A system according to claim 21, wherein the first and second contact contact a first side of the module, and further comprising:

a third contact, a first portion of the third contact contacting the surface and a second portion of the third contact contacting a second side of the module; and a fourth contact adjacent to the third contact, a first portion of the fourth contact contacting the surface and a second portion of the fourth contact contacting the second side of the module, wherein a distance between the first portion of the third contact and the second portion of the third contact is substantially equal to a distance between the first portion of the fourth contact and the second portion of the fourth contact, and wherein the distance between the first portion of the first contact and the second portion of the first contact is not equal to the distance between the first portion of the third contact and the second portion of the third contact.

* * * * *